United States Patent [19]

Kobayashi

[11] 4,346,641

[45] Aug. 31, 1982

[54] APPARATUS FOR AUTOMATICALLY TURNING THE PAGES OF A MUSIC BOX

[76] Inventor: Itaru Kobayashi, 1-15-2, Motomachi, Kiyose City, Tokyo, Japan

[21] Appl. No.: 234,462

[22] Filed: Feb. 17, 1981

[30] Foreign Application Priority Data

Feb. 14, 1980 [JP] Japan ..... 55-17312

[51] Int. Cl.[3] ..... G10G 7/00

[52] U.S. Cl. ..... 84/487; 84/510

[58] Field of Search ..... 84/486, 487, 508–510

[56] References Cited

U.S. PATENT DOCUMENTS

| | | | |
|---|---|---|---|
| 134,557 | 1/1873 | Morawetz | 84/486 X |
| 1,175,746 | 3/1916 | Greene | 84/510 X |
| 1,347,556 | 7/1920 | Russell | 84/487 |
| 1,646,353 | 10/1927 | Elvey | 84/510 |
| 3,064,518 | 11/1962 | Chernishenko | 84/487 |

FOREIGN PATENT DOCUMENTS

| | | | |
|---|---|---|---|
| 359647 | 3/1906 | France | 84/510 |

*Primary Examiner*—Lawrence R. Franklin

*Attorney, Agent, or Firm*—Gifford, VanOphem, Sheridan & Sprinkle

[57] ABSTRACT

The invention relates to an apparatus for automatically turning the pages of a music book which consists of a music book stand, a number of page turning slats piled one over another and pivoted at the top of the music book stand, each of said slats being adapted to be inserted obliquely between every two pages of the music book, a gear arranged behind said page turning slats and said gear provided with a number of circumferentially arranged slits adapted to be engaged with the upper ends of the slats successively during the rotation of the gear so as to turn over each page. An electric motor for driving said gear is under the musician's control.

3 Claims, 3 Drawing Figures

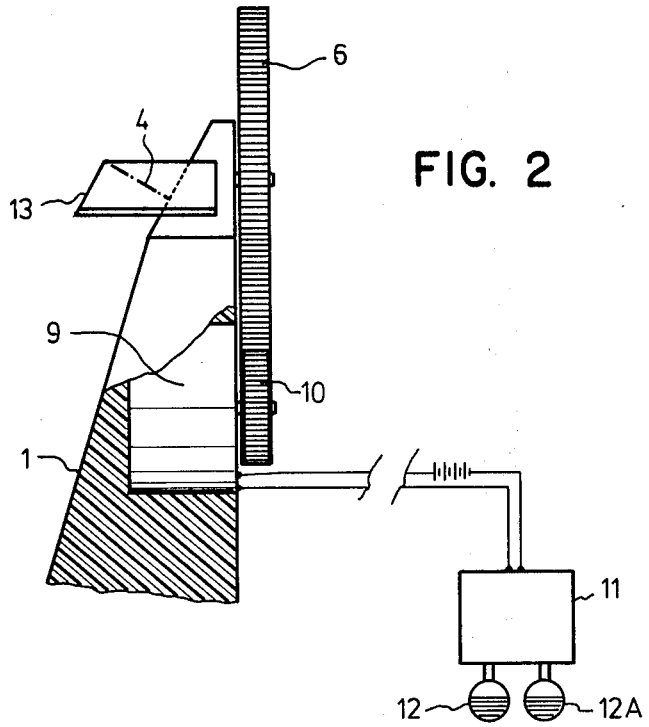
FIG. 2
FIG. 3 (I)
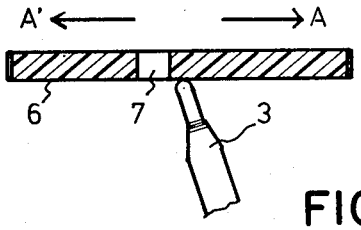
FIG. 3 (III)
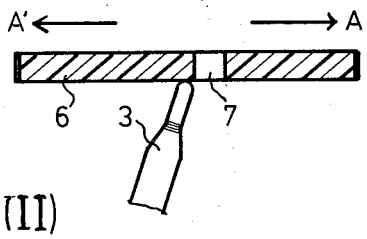
FIG. 3 (II)
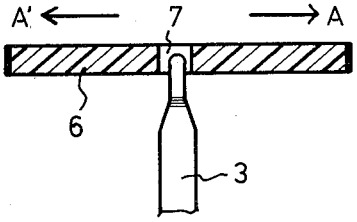

APPARATUS FOR AUTOMATICALLY TURNING THE PAGES OF A MUSIC BOX

BACKGROUND OF THE INVENTION

At a recital, it has often been seen that a musician interupts playing, crouches forward, hurriedly turns the pages of a music book with his hands, and then resumes to play; or that an assistant sitting behind a musician and carefully gazing at the music book, from time to time stands up and turns pages for the musician. Such page turning acts are primitive and troublesome, since no fumbling or mistake is permitted, but no one has succeeded in improving or abolishing these acts.

An object of the present invention is to do away with such defects by means of an apparatus for automatically turning pages.

SUMMARY OF THE INVENTION

The apparatus according to this invention consists of:

a music book stand, a number of page turning slats piled one over another and pivoted at the top of the music book stand, each of said slats being adapted to be inserted obliquely between every two pages of a music book and also being adapted to swing in one direction successively, a gear arranged behind said piled up page turning slats, said gear provided with circumferentially arranged slits which are adapted to engage with the upper ends of said page turning slats during the rotation in succession so as to swing the slats one after another, an electric motor controled by the musician for driving said gear in a clockwise or anti-clockwise direction, and a detachable stool.

BRIEF DESCRIPTION OF THE DRAWING

In the drawing, to which reference will be made in the specification, similar reference characters have been employed to designate corresponding parts throughout the specification.

FIG. 2 is a partial side view of the apparatus with the piled up page turning slats omitted; and FIG. 3 is a partial view showing, step by step, the engagement and disengagement of the slit provided in the gear and the upper end of a page turning slat.

DETAILED DESCRIPTION OF THE PREFERRED EMBODIMENT

Figure 1:
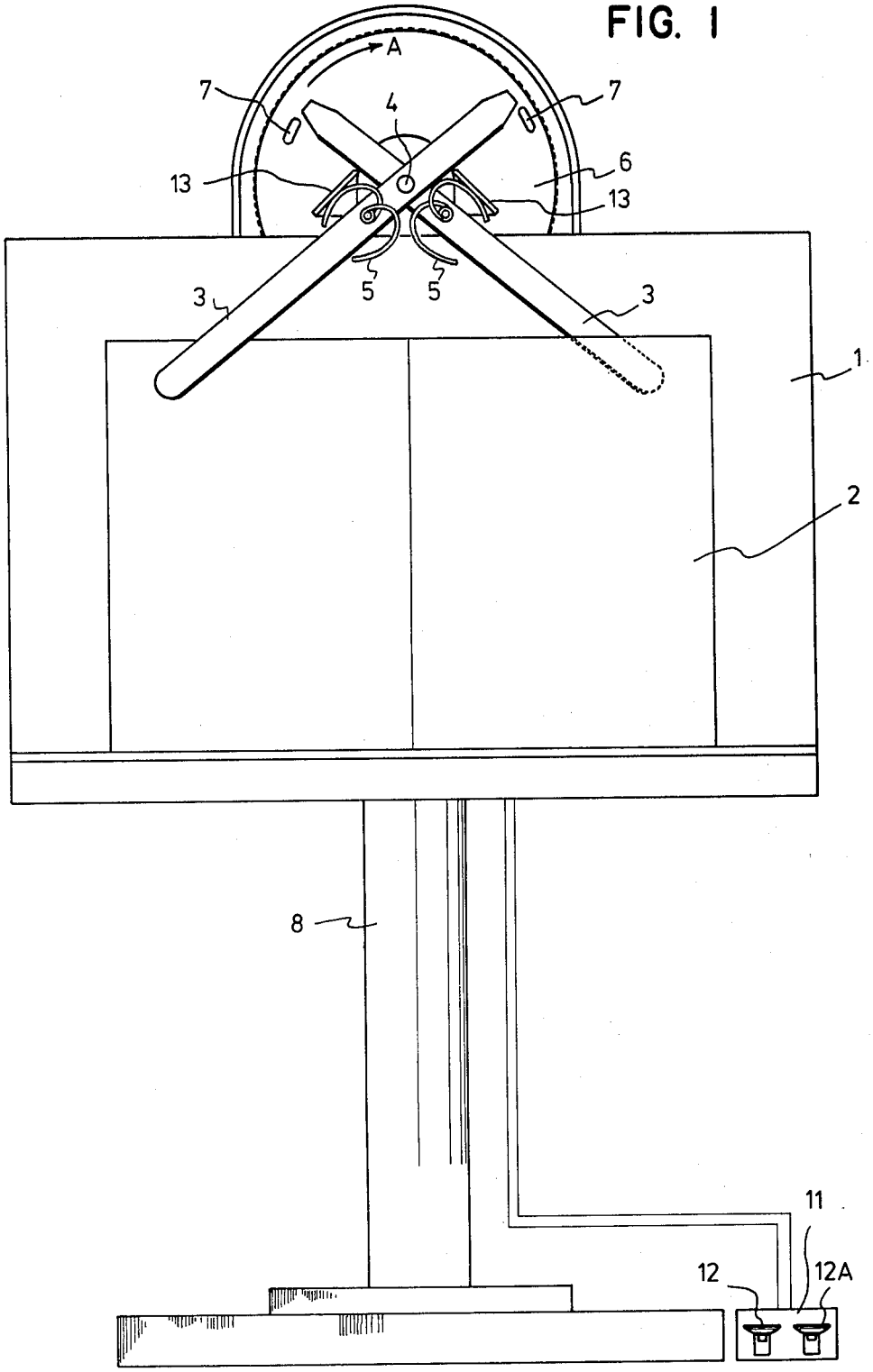
FIG. 1 is a front view of the apparatus.

Referring now to the figures, (1) is a music book stand. (2) is a music book. A number of page turning slats (3) are piled, one over another, and pivoted at the top of the music book stand (1) on the extension of the binding line of the music book (2). (4) is the pivot. Each slat is adapted to be inserted obliquely between every two pages of the music book (2). The distances between the pivot (4) and the upper ends of said slats (3) decrease gradually from the uppermost to the lowermost.

The upper ends of the slats (3) are maintained in slight contact with the face of a gear (6) arranged behind the slats (3).

The gear (6) is provided with circumferentially arranged slits (7), one slit (7) corresponding to each slat (3). If the number of the slats(3) is, for example, five, the number of slits(7) is five, also. Further, as mentioned above, the distances between the pivot (4) and the upper ends of the slats (3) being decreasing gradually from the uppermost to the lowermost, the corresponding slits (7) are respectively at different distances from the pivot (4).

Each page turning slat (3) is provided with an elastic wire loop (5) which acts as a cushion against the impact caused by one of the side barriers (13).

The side barriers (13) define the swingable angle of the slats (3).

An electric motor (9) is placed behind the music book stand (1) and drives the gear (6) through a pinion (10). Said motor can rotate in a clockwise (A) or anti-clockwise (A') direction. (11) is a switch box having two pedals (12) and (12A). One of said pedals, for example, the pedal (12A), is for reversing the direction of the rotation of the motor (9) to the anti-clockwise direction (A') from the clockwise direction (A).

The relative movement between the upper end of a slat (3) and the corresponding slit (7) is shown step by step in FIG. 3(I), FIG. 3(II), and FIG. 3(III).

As is clear from the drawing, during the clockwise rotation (A) of the gear (6), FIG. 3(I) shows the gear (6) and slat (3) just before the engagement of the upper end of a slat (3) with the corresponding slit (7). The slat (3) and slit (7) can be seen fully engaged in FIG. 3(II) and just after disengagement in FIG. 3(III).

Alternatively, during the anti-clockwise direction (A') of the gear (6), FIG. 3(III) shows the gear and end of the slat (3) just before the engagement of the upper end of a slat (3), fully engaged (FIG. 3(II)) and just after disengagement (FIG. (I)).

In use the apparatus according to the present invention is place in front of a musician. While playing, when a musician senses that it is necessary to turn pages of the music book, he may step down on either the pedal (12) for clockwise rotation or the pedal (12A) for anti-clockwise rotation of the gear (6), whereby the turning over of new pages or turning back to already played pages may be effected easily and correctly.

For pianists, the stool (8) can be detached and the apparatus can preferably be placed directly on a piano.

I claim:

1. An apparatus for automatically turning over pages of a music book consisting of:

a music book stand, a number of page turning slats piled one over another and pivoted at the top of said music book stand, each of said slats being adapted to be inserted obliquely between every two pages of a music book and adapted to swing around said pivot between two side barriers, a gear having a number of slits arranged circumferentially and adapted to engage with the upper ends of said slats in succession during its rotation, an electric motor for driving said gear controlled by an ordinary and a reversible switch, and a detachable stool.

2. An apparatus according to claim 1 wherein each of said page turning slats is provided with an elastic wire loop in order to cushion the impact from a side barrier when said slat swings to one direction.

3. An apparatus according to claim 1 wherein said two side barriers define the swinging angle of said page turning slats.

* * * * *

UNITED STATES PATENT AND TRADEMARK OFFICE

CERTIFICATE OF CORRECTION

PATENT NO. : 4,346,641

DATED : August 31, 1982

INVENTOR(S) : Itaru Kobayashi

It is certified that error appears in the above—identified patent and that said Letters Patent is hereby corrected as shown below:

Title: delete "BOX" and insert --BOOK--.

Col. 1, line 7, delete "interupts", insert --interrupts--

Col. 1, line 32, delete "controled", insert --controlled".

Col. 2, line 28, after "gear", insert --(6)--.

Col. 2, line 33, delete "place", insert --placed--.

Signed and Sealed this

*Twenty-second* Day of *February 1983*

[SEAL]

*Attest:*

GERALD J. MOSSINGHOFF

*Attesting Officer*

*Commissioner of Patents and Trademarks*